US010378161B2

(12) United States Patent
Whitaker

(10) Patent No.: US 10,378,161 B2
(45) Date of Patent: Aug. 13, 2019

(54) TEXTILE DISPENSING APPARATUS AND METHOD OF USE

(71) Applicant: Korey K. Whitaker, Ogden, UT (US)

(72) Inventor: Korey K. Whitaker, Ogden, UT (US)

( * ) Notice: Subject to any disclaimer, the term of this patent is extended or adjusted under 35 U.S.C. 154(b) by 0 days.

(21) Appl. No.: 16/262,856

(22) Filed: Jan. 30, 2019

(65) Prior Publication Data

US 2019/0161922 A1 May 30, 2019

(51) Int. Cl.

| | |
|---|---|
| ***E01C 23/00*** | (2006.01) |
| ***E01C 23/03*** | (2006.01) |
| ***E02D 3/00*** | (2006.01) |
| ***E01C 21/00*** | (2006.01) |
| ***E02D 17/20*** | (2006.01) |

(52) U.S. Cl.

CPC ..... *E01C 23/03* (2013.01); *E01C 21/00* (2013.01); *E02D 3/00* (2013.01); *E02D 17/202* (2013.01); *E02D 2300/0085* (2013.01)

(58) Field of Classification Search

CPC . E01C 21/00; E01C 23/03; E02D 3/00; E02D 17/202; E02D 2300/0085

USPC ..... 404/75, 100, 72

See application file for complete search history.

(56) References Cited

U.S. PATENT DOCUMENTS

| | | | | |
|---|---|---|---|---|
| 3,632,054 | A * | 1/1972 | Heppelmann | E01C 23/04 242/557 |
| 4,272,213 | A * | 6/1981 | McGovarin | E01C 19/40 404/104 |
| 4,742,970 | A * | 5/1988 | Barazone | E01C 19/522 242/557 |
| 4,828,432 | A * | 5/1989 | Ives | B29C 63/0021 405/270 |
| 5,620,281 | A * | 4/1997 | Lammers | B09B 1/004 405/129.9 |
| 6,558,080 | B2 * | 5/2003 | Kozak | B09B 1/004 172/324 |
| 7,316,521 | B2 * | 1/2008 | Shiomoto | E01C 23/03 156/497 |
| 8,079,778 | B2 * | 12/2011 | Colkitt | E01C 23/04 242/557 |
| 8,888,403 | B2 * | 11/2014 | Atherton | E01C 19/15 404/108 |
| 2009/0274516 | A1 * | 11/2009 | Colkitt | E01C 23/04 404/75 |
| 2014/0326821 | A1 | 11/2014 | Bishop | B62D 1/185 |
| 2015/0225195 | A1 | 8/2015 | Bishop | B65H 18/20 |
| 2018/0320332 | A1 | 11/2018 | Booth et al. | E02D 17/202 |

FOREIGN PATENT DOCUMENTS

| | | | | |
|---|---|---|---|---|
| EP | 0387114 | A1 * | 9/1990 | E01C 23/04 |

* cited by examiner

*Primary Examiner* — Raymond W Addie
(74) *Attorney, Agent, or Firm* — Michael R. Schramm

(57) ABSTRACT

A method and apparatus for efficiently laying geotextile or like material on a preferably prepared target surface. The apparatus includes a tractor or like machine mountable dispensing device mounted to a tractor or like construction machine and having at least one roll of geotextile or like material rollingly and dispensingly mounted to the device. The apparatus is used in rolling out and laying down geotextile or like material on a target surface as the tractor or like machine drives/rolls/moves along or in near proximity to the target surface.

20 Claims, 3 Drawing Sheets

TEXTILE DISPENSING APPARATUS AND METHOD OF USE

FIELD OF THE INVENTION

The present invention relates to methods and apparatuses for dispensing textiles or like materials, and more especially to the improved efficiency of dispensing geotextiles such as in the use for preparing roadbeds or like surfaces.

BACKGROUND OF THE INVENTION

Geotextiles are fabric-like materials commonly used in the construction of roads, parking lots, airfields, embankments, etc. to provide strength, stability, and erosion prevention in the underlying soil while typically providing permeability (see Appxs A, B, & C). It is common in the application of geotextiles, that the surface on which the geotextile is to be placed, is first prepared by leveling and smooth the surface, and then laying the geotextile down such that the geotextile lays flat and smooth (and commonly overlapped). Moreover, in some applications, more than one layer of geotextile is placed on the intended surface (e.g. roadbed) so as to achieve a particular geotextile effect (e.g. a first layer having a high strength but excessively high permeability, and a second layer having lower strength but optimal permeability). Given the substantially large surface areas to be covered with geotextiles (e.g. hundreds of thousands of square feet), and given the size of rolls of geotextile material (e.g. 17-foot widths and 2-foot diameters), handling geotextile material and smoothly laying it down on an intended surface can be inordinately labor intensive and time consuming. Certain prior art geotextile materials and apparatuses have been developed. Exemplary prior art geotextile materials and apparatuses include US 20140326821 to Bishop, US 20150225195 to Bishop, and US 20180320332 to Booth et al., all of which are incorporated herein in their entirety by this reference.

SUMMARY OF THE INVENTION

The present invention is a method and apparatus for efficiently laying geotextile or like material on a preferably prepared target surface. The apparatus preferably defines a tractor or like machine mountable dispensing device mounted to a tractor or like construction machine and having at least one roll of geotextile or like material rollingly and dispensingly mounted to the device. The apparatus is used in rolling out and laying down geotextile or like material on a target surface as the tractor or like machine drives/rolls/moves along or in near proximity to the target surface.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
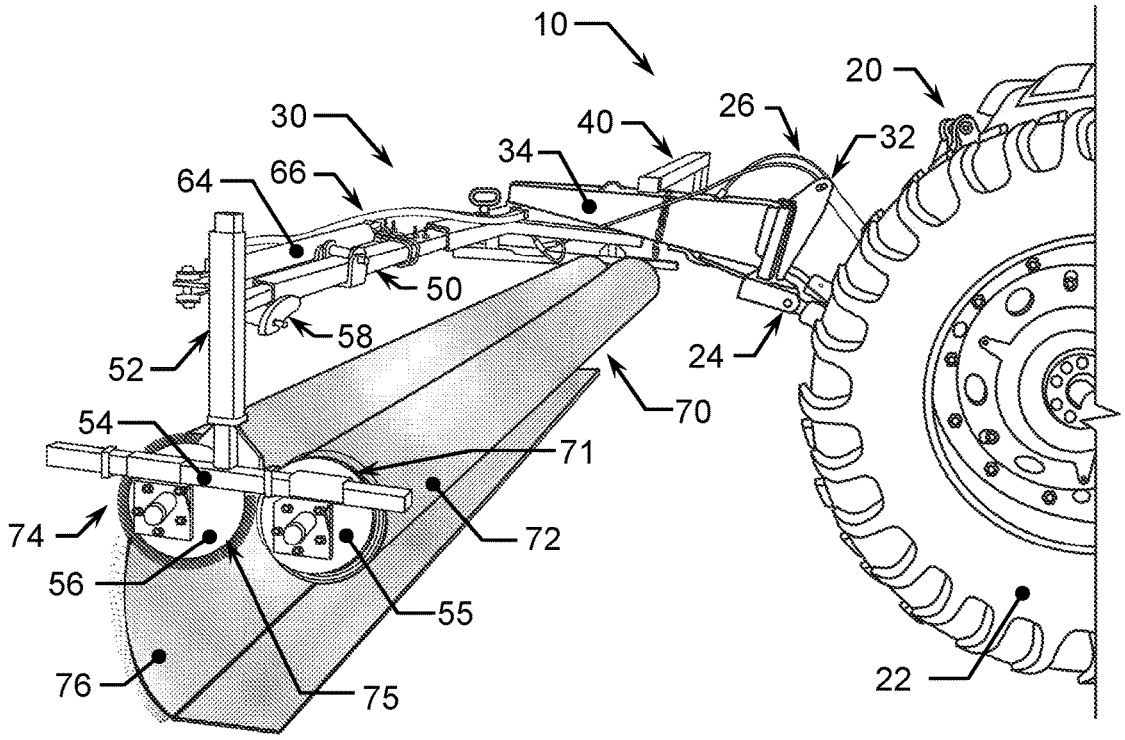
FIG. 1 is a side-trimetric view of a first embodiment of the invention with the geotextile in a ready-to-dispense mode.
Figure 2:
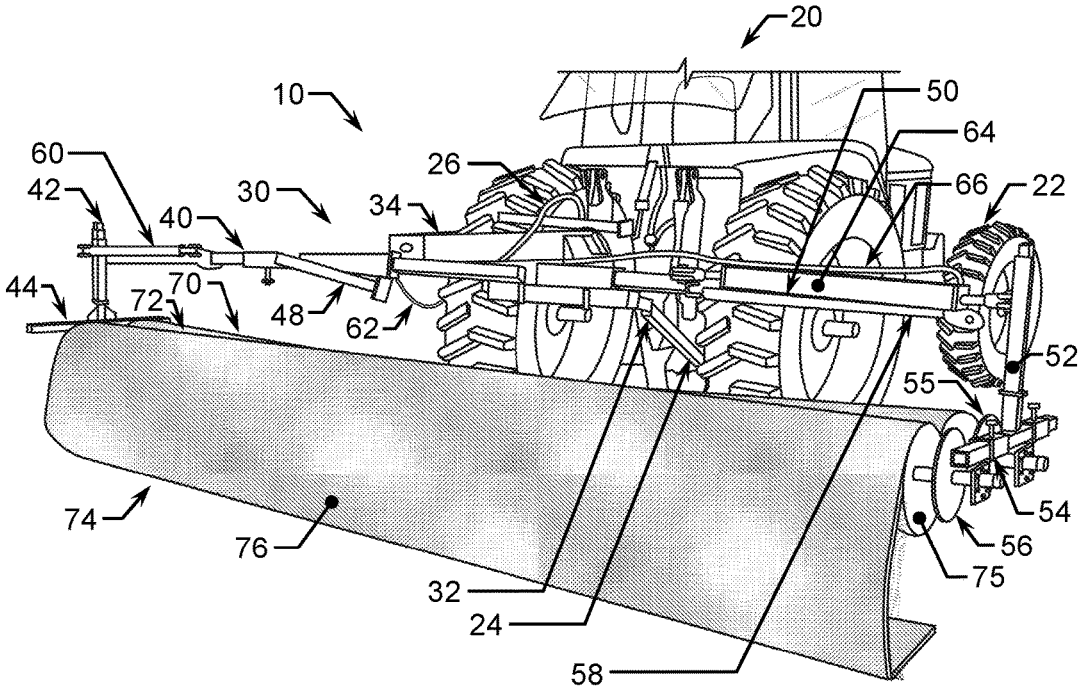
FIG. 2 is a rear-trimetric view of a first embodiment of the invention with the geotextile in a ready-to-dispense mode.
Figure 3:
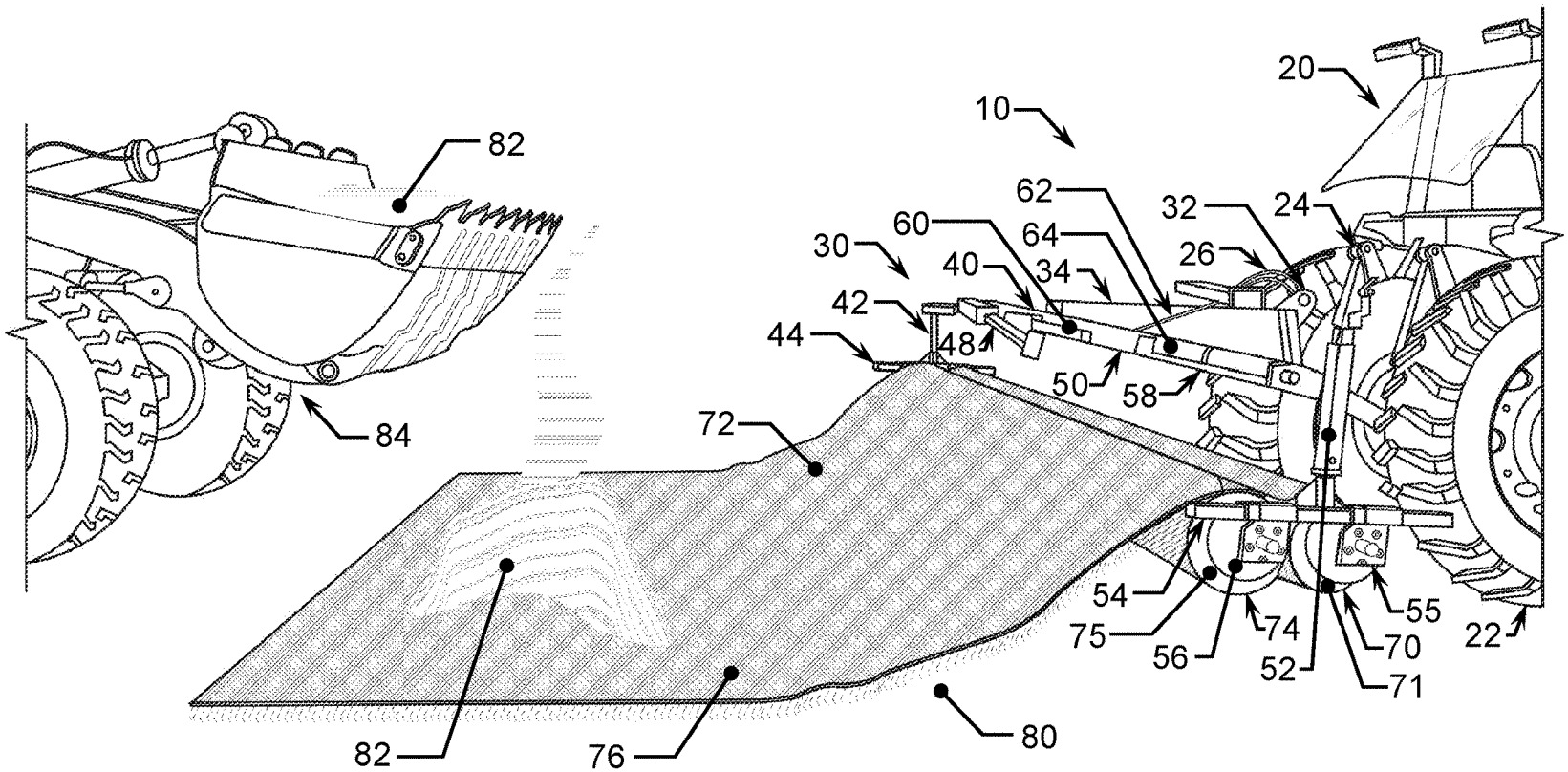
FIG. 3 is a side-trimetric view of a first embodiment of the invention with the geotextile in a dispense-initiated mode.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature list is provided below. It is noted that like features are like numbered throughout all of the figures.

FEATURE TABLE

| # | Feature | # | Feature |
|---|---|---|---|
| 10 | Dispensing apparatus | | |
| 20 | Tractor | 22 | Tractor tire |
| 24 | Tractor three-point hitch | 26 | Tractor hydraulic line |
| 30 | Dispensing device | 32 | Three-point hitch mount interface |
| 34 | Cantilever beam | 40 | LH extension arm |
| 42 | LH carrier post | 44 | LH carrier rack |
| 45 | LH front hub | 46 | LH rear hub |
| 48 | LH leg stand | 50 | RH Extension arm |
| 52 | RH carrier post | 54 | RH carrier rack |
| 55 | RH front hub | 56 | RH rear hub |
| 58 | RH Leg stand | 60 | LH hydraulic ram |
| 62 | LH hydraulic line | 64 | RH hydraulic ram |
| 66 | RH hydraulic line | | |
| 70 | Front geotextile roll assembly | 71 | Mandrel |
| 72 | First geotextile material | 74 | Rear geotextile roll assembly |
| 75 | Mandrel | 76 | Second geotextile material |
| 80 | Target surface | 82 | Soil |
| 84 | Loader | | |

Referring now to the drawings, the invention is a dispensing apparatus 10 and method of use of such apparatus in efficiently laying geotextile and like materials, comprising a tractor 20, a dispensing device 30, a front geotextile roll assembly 70, and a rear geotextile roll assembly 74. The invention also contemplates a target surface 80, soil (dirt) 82, and a loader (such as a standard front-end loader) 84.

Tractor 20 further preferably defines a substantially general-purpose utility tractor having tractor tires 22, a three-point hitch 24 (see Appx D), and a plurality of pressure transmissible hydraulic lines 26. It shall be noted that similar machine having an actuatable attach and lift mechanism and an ability to move dispensing device 30 over a target surface 80, such as a skid steer loader type machine, may be readily substituted for tractor 20.

Dispensing device 30 further preferably defines a dispensing device having a three-point hitch mount interface 32, a cantilever beam 34, a left-hand (LH) extension arm 40, a LH carrier post 42, a LH carrier rack 44, a LH front hub 45, a LH rear hub 46, a LH leg stand 48, a right-hand (RH) extension arm 50, a RH carrier post 52, RH carrier rack 54, a RH front hub 55, a RH rear hub 56, a RH leg stand 58, a LH hydraulic ram 60, a LH hydraulic line 62, a RH hydraulic ram 64, and a RH hydraulic line 66. LH extension arm 40 and RH extension arm 50 further define telescopically extendable and retractable arms. All of the noted members of dispensing device 30 are constructed of steel or other suitable materials.

Dispensing device 30 is assembled/constructed such that three-point hitch mount interface 32 is connected to a first end of cantilever beam 34, and a first end of LH extension arm 40 and a first end of RH extension arm 50 are connected to LH and RH sides of a second end of cantilever beam 34 respectively. A second end of LH extension arm 40 is connected to an upper end of LH carrier post 42 and LH carrier rack 44 is connected to a lower end of LH carrier post 42. LH front hub 45 is connected to a front end of LH carrier rack 44 and LH rear hub 46 is connected to a rear end of LH carrier rack 44 such that LH front hub 45 and LH rear hub 46 are substantially freely rotatable. LH leg stand 48 is pivotably connected to LH extension arm 40 such that LH leg stand 48 may be pivoted into a downward standing position or in an upward stowed position. LH hydraulic ram 60 is extendably and retractably connected to LH extension arm 40 and LH hydraulic line 62 is hydraulic fluid pressure transmissibly ported to LH hydraulic ram 60 and is tethered to LH extension arm 40 and cantilever beam 34 at select locations. A second end of RH extension arm 50 is connected to an upper end of RH carrier post 52 and RH carrier rack 54 is connected to a lower end of RH carrier post 52. RH front hub 55 is connected to a front end of RH carrier rack 54 and RH rear hub 56 is connected to a rear end of RH carrier rack 54 such that RH front hub 55 and RH rear hub 56 are substantially freely rotatable. RH leg stand 58 is pivotably connected to RH extension arm 50 such that RH leg stand 58 may be pivoted into a downward standing position or in an upward stowed position. RH hydraulic ram 64 is extendably and retractably connected to RH extension arm 50 and RH hydraulic line 66 is hydraulic fluid pressure transmissibly ported to RH hydraulic ram 64 and is tethered to RH extension arm 50 and cantilever beam 34 at select locations. It is noted that LH carrier post 42, RH carrier post 52, LH carrier rack 44, RH carrier rack 54, LH front hub 45, LH rear hub 46, RH front hub 55, and RH rear hub 56 are all preferably adjustable to accommodate various geotextile roll assemblies of different lengths, roll outer diameters, and mandrel (spool) (see Appx E) inner diameters.

Front geotextile roll assembly 70 further preferably defines a hollow mandrel 71 having a quantity of a first geotextile material 72 wound thereon. Rear geotextile roll assembly 74 further preferably defines a hollow mandrel 75 having a quantity of a second geotextile material 76 wound thereon.

Target surface 80 preferably defines a prepared (e.g. leveled and smoothed or groomed) target surface such as an unfinished roadbed upon which geotextile is to be laid. Soil 82 preferably defines a conventional soil (dirt) but may alternately be any gravel or like construction material. Loader 84 preferably defines a general-purpose loader capable of loading, transporting, and depositing a quantity of soil 82.

Dispensing apparatus 10 is assembled such that three-point hitch mount interface 32 of dispensing device 30 is mounted/coupled to three-point hitch 24 of tractor 20 such that dispensing device 30 may be raised and lowered by raising and lowering three-point hitch 24 of tractor 20. LH hydraulic line 62 and RH hydraulic line 66 are hydraulic fluid pressure transmissibly coupled (preferably via quick-disconnect connections) to pressure transmissible hydraulic lines 26 of tractor 20 such that LH hydraulic ram 60 and RH hydraulic ram 64 are actuatable via operation from tractor 20 such that LH hydraulic ram 60 and RH hydraulic ram 64 are extendable and retractable so as to cause a corresponding telescopic extension and retraction of LH extension arm 40 and RH extension arm 50 respectively. With dispensing device 30 in a somewhat raised position (either raised via hydraulic activation or via resting on LH leg stand 48 and RH leg stand 58) and LH extension arm 40 and RH extension arm 50 in an extended position, front geotextile roll assembly 70 is positioned between LH front hub 45 and RH front hub 55 and rear geotextile roll assembly 74 is positioned between LH rear hub 46 and RH rear hub 56. LH extension arm 40 and RH extension arm 50 are retracted a predetermined amount such that LH front hub 45 and RH front hub 55 are holdingly but rotatably position in hollow mandrel 71 of front geotextile roll assembly 70 and such that LH rear hub 46 and RH rear hub 56 are holdingly but rotatably position in hollow mandrel 75 of rear geotextile roll assembly 74 so as to form a multi-roll/calender (see Appx F) dispensing system. With dispensing apparatus 10 thus assembled, dispensing apparatus 10 is prepared and ready to dispense (lay down) first geotextile material 72 and second geotextile material 76 onto target surface 80.

In practice, dispensing apparatus 10 is used by positioning dispensing apparatus 10, and more specifically dispensing device 30 with front geotextile roll assembly 70 and rear geotextile roll assembly 74 near the beginning of a prepared target surface 80, and by rolling out a predetermined amount of a first geotextile material 72 and second geotextile material 76, and placing a predetermined amount of a first geotextile material 72 and second geotextile material 76 preferably smoothly and flatly onto prepared target surface 80. First geotextile material 72 and second geotextile material 76 are secured to target surface 80 by placing a predetermined quantity of soil 82 such as by means of pouring soil 82 out of loader 84 but alternate securing means may also be employed. Tractor 20 is then driven along or in near proximity to target surface 80 while first geotextile material 72 and second geotextile material 76 are preferably rapidly and efficiently dispensed and preferably smoothly and flatly laid on target surface 80. Once laid out in the noted proficient manner, the target surface can be further worked such as by placing additional construction materials thereon. It is noted that in addition having multiple geotextile holding and rolling means and simultaneously laying down a plurality of rolls of geotextile material, in an alternate embodiment, a dispensing apparatus having a single a single geotextile holding and rolling means and laying down a single roll of geotextile material is disclosed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A textile dispensing apparatus having a coupling portion adapted to be coupled to a movable vehicle, a plurality of rotatable hubs, and at least one extendable and retractable arm adapted so as to be able to grasp and hold a textile spool while said textile spool may be substantially freely rotated, wherein at least two of said plurality of rotatable hubs are arranged substantially in tandem.

2. The apparatus of claim 1, wherein said movable vehicle defines at least one of a wheeled tractor and a tracked vehicle.

3. The apparatus of claim 1, wherein said apparatus includes a plurality of extendable and retractable arms.

4. The apparatus of claim 1, wherein said at least one extendable and retractable arm defines a telescopically extendable and retractable arm.

5. The apparatus of claim 1, wherein said at least one extendable and retractable arm is hydraulically actuated.

6. The apparatus of claim 1, wherein said apparatus includes a plurality of telescopically hydraulically extendable and retractable arms, and wherein at least two of said telescopically extendable and retractable arms define a pair of arms adapted to retract away from each other and extend toward each other, and wherein said apparatus is adapted such that actuation of said pair of telescopically extendable and retractable arms causes a textile spool to be rotatably grasped.

7. The apparatus of claim 1, wherein said textile spool defines a textile spool having at least one of a width of up to 17 feet and a diameter of up to 2 feet.

8. The apparatus of claim 1, wherein said apparatus is adapted to simultaneously dispense a plurality of textiles, and wherein said overlap defines a first textile substantially overlaying a second textile.

9. The apparatus of claim 1, wherein said textiles include a first textile and a second textile, and wherein a non-size physical property of said first textile differs from a non-size physical property of said second textile.

10. A textile dispensing apparatus having a coupling portion adapted to be coupled to a movable vehicle, a plurality of rotatable hubs, and at least one extendable and retractable arm adapted so as to be able to grasp and hold a textile spool while said textile spool may be substantially freely rotated, wherein said apparatus is adapted so as to accommodate variation in a plurality of length, outer diameter, and inner diameter of a textile spool.

11. The apparatus of claim 10, wherein said movable vehicle defines at least one of a wheeled tractor and a tracked vehicle.

12. The apparatus of claim 10, wherein said device includes a plurality of extendable and retractable arms.

13. The apparatus of claim 10, wherein said at least one extendable and retractable arm defines a telescopically extendable and retractable arm.

14. The apparatus of claim 10, wherein said at least one extendable and retractable arm is hydraulically actuated.

15. The apparatus of claim 10, wherein said device includes a plurality of telescopically hydraulically extendable and retractable arms, and wherein at least two of said telescopically extendable and retractable arms define a pair of arms adapted to retract away from each other and extend toward each other, and wherein said apparatus is adapted such that actuation of said pair of telescopically extendable and retractable arms causes a textile spool to be rotatably grasped.

16. The apparatus of claim 10, wherein said textile spool defines a textile spool having at least one of a width of up to 17 feet and a diameter of up to 2 feet.

17. The apparatus of claim 10, wherein said apparatus is adapted to simultaneously dispense a plurality of textiles such that a first textile substantially overlays a second textile.

18. The apparatus of claim 10, wherein said apparatus includes a first textile and a second textile mounted thereon, and wherein a non-size physical property of said first textile differs from a non-size physical property of said second textile.

19. A method of dispensing textiles comprising providing a textile dispensing apparatus having a movable vehicle adapted to couple to an implement and a textile dispensing device having a coupling portion adapted to be coupled to a movable vehicle, a plurality of rotatable hubs, and at least one extendable and retractable arm adapted so as to be able to grasp and hold a textile spool while said textile spool may be substantially freely rotated, wherein said apparatus is adapted to as to accommodate at least one of a plurality of rotatable hubs arranged substantially in tandem and variation in at least one of length, outer diameter, and inner diameter of a textile spool, and wherein said textile dispensing device is removably coupled to said movable vehicle, and moving said apparatus proximate to a target surface such that textiles are dispensed onto said target surface.

20. The method of claim 19, wherein said movable vehicle defines at least one of a wheeled tractor and a tracked vehicle, and wherein said textile dispensing device defines a hydraulically actuated textile dispensing device, and wherein when textile is dispensed a plurality of types of textiles are simultaneously dispensed such that said first textile substantially overlays said second textile, and wherein at least one of the strength and permeability of said first textile differs from the strength and permeability of said second textile.

* * * * *